US010960673B2

(12) United States Patent
Izawa et al.

(10) Patent No.: US 10,960,673 B2
(45) Date of Patent: Mar. 30, 2021

(54) INKJET PRINTER

(71) Applicant: MIYAKOSHI PRINTING MACHINERY CO., LTD., Narashino (JP)

(72) Inventors: Hideo Izawa, Narashino (JP); Kouichi Ooyama, Yokote (JP); Kazushige Sato, Yokote (JP); Masaru Kusanagi, Yokote (JP); Masatoshi Mutoh, Yokote (JP)

(73) Assignee: MIYAKOSHI PRINTING MACHINERY CO., LTD., Narashino (JP)

( * ) Notice: Subject to any disclaimer, the term of this patent is extended or adjusted under 35 U.S.C. 154(b) by 0 days.

(21) Appl. No.: 16/701,605

(22) Filed: Dec. 3, 2019

(65) Prior Publication Data

US 2020/0269585 A1 Aug. 27, 2020

(30) Foreign Application Priority Data

Feb. 26, 2019 (JP) ..... JP2019-033228

(51) Int. Cl.
*B41J 2/17* (2006.01)

(52) U.S. Cl.
CPC ..... *B41J 2/1714* (2013.01)

(58) Field of Classification Search
CPC ..... B41J 2/1714
See application file for complete search history.

(56) References Cited

U.S. PATENT DOCUMENTS

2007/0109348 A1* 5/2007 Izawa ..... B41J 25/3088 347/34
2014/0313259 A1 10/2014 Arimizu et al.
2015/0266309 A1* 9/2015 Nakata ..... B41J 2/1714 347/34

(Continued)

FOREIGN PATENT DOCUMENTS

EP 3290212 A1 3/2018
JP 2007-136761 A 6/2007

(Continued)

OTHER PUBLICATIONS

Jul. 23, 2020 extended Search Report issued in European Patent Application No. 19218388.7.

*Primary Examiner* — Julian D Huffman
(74) *Attorney, Agent, or Firm* — Oliff PLC

(57) ABSTRACT

An inkjet printer collects ink mist, and eliminates the necessity of frequent filter cleaning and replacement. Vents are on an upstream side in a conveying direction of a printing medium of the print heads of a printing part, blowout air volume of the respective vents can be adjusted, collection ports are on a downstream side in the conveying direction of the printing medium of the respective print heads, suction air volume of the collection ports can be adjusted, and an ink mist collecting parts are each provided which liquefies and collects ink mist contained in air sucked from any one of the collection ports while the air passes through filters. The blowout air volumes of the respective print heads and the suction air volumes are set to air volumes according to amounts of generated ink mist, and ink mist is collected according to differences in amounts of generated ink mist.

7 Claims, 10 Drawing Sheets

(56) References Cited

U.S. PATENT DOCUMENTS

| | | | | |
|---|---|---|---|---|
| 2015/0273835 | A1* | 10/2015 | Arimizu | B41J 2/1714<br>347/30 |
| 2016/0236473 | A1* | 8/2016 | Shimizu | B41J 2/16517 |
| 2016/0236491 | A1* | 8/2016 | Asamoto | B41J 29/13 |
| 2017/0341399 | A1* | 11/2017 | Arimizu | B41J 2/175 |
| 2019/0009567 | A1 | 1/2019 | Miyakoshi et al. | |
| 2019/0240981 | A1* | 8/2019 | Tachibana | B41J 2/16517 |

FOREIGN PATENT DOCUMENTS

| | | | |
|---|---|---|---|
| JP | 2007-160871 | A | 6/2007 |
| JP | 2010-234818 | A | 10/2010 |
| JP | 5028825 | B2 | 9/2012 |
| JP | 2015-193219 | A | 11/2015 |

* cited by examiner

INKJET PRINTER

TECHNICAL FIELD

The present invention relates to an inkjet printer which prints an image on a printing medium by an inkjet type printing part, and, more specifically, to an inkjet printer which can collect ink mist.

BACKGROUND ART

In an inkjet printer (also referred to as an inkjet recording apparatus), when ink is ejected on the printing face of the printing medium (also referred to as a recording medium) to print (also referred to as record) an image, ink mist comprised of minute and light ink droplets can be generated aside from ink droplets which are to be adhered to a printing face of the printing medium and form an image.

Most of such ink mist floats in the air without adhering to the printing medium, which can result in a poor ink ejection due to adhesion of ink mist to a nozzle face (also referred to as a head bottom face) of a print head (also referred to as a recording head) and in ink mist stain of rollers for conveying the printing medium due to adhesion of ink mist thereto.

Therefore, it is necessary to collect ink mist floating in the air immediately after ink mist is generated, and, conventionally, various kinds of inkjet printers configured to allow for collecting ink mist have been proposed.

In an inkjet printer disclosed in Japanese Patent Laid-Open No. 2015-193219, there are provided an air suction and blowout mechanism which has blowout holes and suction holes, respectively on a downstream side in a conveying (moving) direction of a printing medium for a plurality of print heads (recording heads) which constitute an inkjet type printing part, such that ink mist is suctioned through suction holes together with the air blown out from the blowout holes and collected.

In an inkjet printer disclosed in Japanese Patent Laid-Open No. 2007-136761, there are provided an air blowout nozzle including a fan on an upstream side in a conveying direction of a printing medium (on an upstream side of a recording paper moving direction) of a print head (inkjet head) on the uppermost stream side in the conveying direction of the printing medium (recording paper moving direction), an air suction and blowout part comprising a fan and a filter between print heads, and an air suction apparatus including a fan and a filter on a downstream side in the conveying direction of the printing medium of a print head on the lowermost stream side in the conveying direction of the printing medium, such that ink mist is carried on a flow of the air blown out from the upstream side toward the downstream side in the conveying direction of the printing medium, then sucked, captured and collected by the filter on the downstream side.

In an inkjet printer (image recording apparatus) disclosed in Japanese Patent Laid-Open No. 2010-234818, there are provided suction mechanisms each having a sucking fan and a filter respectively on an upstream side in a conveying direction of a printing medium of a print head (recording head) located on an uppermost stream side in the conveying direction of the printing medium (recording medium conveying direction) and on a downstream side in the conveying direction of the printing medium of a print head (recording head) located on a lowermost stream side in the conveying direction of the printing medium, such that ink mist is sucked together with air, captured by the filter and collected.

In an inkjet printer disclosed in Japanese Patent Laid-Open No. 2007-160871, there are provided an apparatus having a filter, a sucking fan and a waste liquid tank in a box (carriage) on which a print head (recording head) is mounted, such that ink mist is liquefied while ink mist passes through the filter, and the liquefied ink mist is stored in the waste liquid tank to collect it.

For collecting ink mist, as disclosed in Japanese Patent Laid-Open No. 2015-193219 and Japanese Patent Laid-Open No. 2007-136761, a volume of blowout air (blowout air volume) and a volume of suction air (suction air volume) are important. For example, when a suction air volume is small, ink mist could not be sufficiently collected, while, when the suction air volume is large, ink droplets for printing would be adversely affected.

That is, blowout air volume and suction air volume which are appropriate for collecting ink mist would vary depending on a distance (head gap) between a printing face of the printing medium and a nozzle face of the print head, and as an ink ejection amount or the like, and, at the time of printing with a plurality of print heads in different colors, as an amount of generated ink mist would vary for each print head, the blowout air volume and suction air volume appropriate for collecting ink mist would vary too.

When collecting ink mist in the inkjet printer disclosed in Japanese Patent Laid-Open No. 2015-193219, as it is impossible to set different volumes of blowout and suction air at each air blowout and suction mechanism, it is impossible to cope with the difference in amounts of generated ink mist at respective print heads, which would lead to an insufficient collection of ink mist.

When collecting ink mist in the inkjet printer disclosed in Japanese Patent Laid-Open No. 2007-136761, while it is possible to vary blowout and suction air volumes by changing a rotational speed of each fan, in the air suction and blowout apparatuses, as the suction air volume from the nozzle face of the print head on the upstream side in the conveying direction of the printing medium is the same as the blowout air volume to the nozzle face of the print head on the downstream side in the conveying direction of the printing medium, it is impossible to cope with difference in generated ink mist amounts for respective print heads.

Moreover, as ink mist is captured by the filter and collected, the filter would get clogged in an early stage, air suction performance would be decreased, and ink mist collection performance also would be decreased, and it would be necessary to frequently clean and replace the filter, which would be a troublesome work.

When collecting ink mist in the inkjet printer disclosed in Japanese Patent Laid-Open No. 2010-234818, as it is impossible to set different volumes of blowout air and suction air for respective print heads, it is impossible to cope with difference in amounts of generated ink mist at respective print heads.

Moreover, as ink mist captured by the filter and collected, the filter would get clogged in an early stage, it would be necessary to frequently clean and replace the filter, which would be a troublesome work.

Still further, as the suction mechanism is provided inside the box (carriage) in which the print heads are provided, and air after having passed through the filter flows inside the box, and as a certain amount of ink mist would be contained in the air, ink mist flows inside the box and would be adhered to the print head and could adversely affect printing operation.

When collecting ink mist in the inkjet printer disclosed in Japanese Patent Laid-Open No. 2007-160871, as the apparatus having the filter, the suction fan and the waste liquid tank is provided in a box, the box is increased in size.

Moreover, as the waste liquid tank is provided inside the box, it would be a troublesome work to discharge liquefied ink mist stored in the waste liquid tank.

The present invention has been made to solve the above-mentioned problems, and an object of the present invention is to provide an inkjet printer in which ink mist can be collected corresponding to difference in amounts of generated ink mist at each of a plurality of print heads, liquefied ink mist can be easily discharged without the necessity of frequent cleaning and replacement of filters, and further, ink mist can be prevented from flowing inside a box in which the print heads are provided, and the box can be made compact.

SUMMARY OF INVENTION

Problem to be Solved by Invention

The present invention is concerned with an inkjet printer of the present invention comprising a conveying part to convey a printing medium in a predetermined direction, a printing part to print on a printing face of the printing medium conveyed by the conveying part, an exhaust parts to collect ink mist generated at the printing part and a blowing part, wherein, the printing part comprises a box, and a plurality of print heads spaced apart in a conveying direction of the printing medium inside the box, the blowing part comprises an air blower, a plurality of vents respectively provided at the respective print heads on an upstream side in the conveying direction of the printing medium, an air blowing path which connects an ejection port of the air blower and the respective vents respectively, and blowout air volume control means for respectively adjusting blowout air volume of respective vents, the exhaust part comprises an exhaust blower, a plurality of collection ports respectively provided at the respective print heads on a downstream side in the conveying direction of the printing medium, an exhaust path which connects a suction port of the exhaust blower and respective collection ports respectively, an ink mist collecting part provided in the exhaust path and configured to liquefy ink mist contained in the air sucked from respective collection ports while it passes through a filter, and a suction air volume control means for respectively adjusting suction air volume of the respective collection ports, the ink mist collecting part has the filter to liquefy ink mist while air passes there-through and a mist storage tank in which the liquefied ink mist is to be stored, and the air blower, the exhaust blower, the blowout air volume control means, the ink mist collecting part, and the suction air volume control means are provided outside the box.

In the inkjet printer of the present invention, ink mist collecting part comprises an inflow chamber which has an inflow hole at an upper part and which is opened at a lower part and an outflow chamber which has an outflow hole at an upper part and which is opened at a lower part, and may configured that the inflow hole is connected to the collection ports, the outflow hole is connected to the suction port of the exhaust blower, so that air containing ink mist flows from the upper part to the lower part of the inflow chamber, flows in the lower part of the outflow chamber and flows from the lower part to the upper part of the outflow chamber, filters are provided in the inflow chamber and the outflow chamber respectively to liquefy ink mist while the air passes there-through, the mist storage tank in which the liquefied ink mist is to be stored is provided below the inflow chamber and the outflow chamber, and a drain valve for discharging the liquefied ink mist within the mist storage tank is provided.

According to the inkjet printer, as the air containing ink mist passes through the filters from above to below, further, passes through the filters from below to above and passes through the whole area of the filters, it is possible to reliably liquefy ink mist contained in the air.

As the mist storage tank is provided below the inflow chamber and the outflow chamber, the liquefied ink mist could be smoothly fallen down without adhering to the inflow chamber and the outflow chamber and may be stored in the mist storage tank, so that the liquefied ink mist could be reliably collected in the mist storage tank.

The liquefied ink mist stored in the mist storage tank can be easily discharged by opening the drain valve.

In the inkjet printer of the present invention, one air blower is provided, the air blowing path is branched into as many air blowing paths as the vents, the branched air blowing paths are connected to the respective vents, there is provided an air volume adjusting part in each branched air blowing path as the blowout air volume control means, the air volume adjusting part is provided outside the box, there are as many exhaust blowers as collection ports, the suction ports of the respective exhaust blowers are connected to the respective collection ports through the exhaust paths respectively, and the suction air volume control means is provided in order to make the suction air volume of each exhaust blower changeable.

According to the inkjet printer, as it is enough to have one air blower, and the suction air volume control means is enough to control the rotational speed of the exhaust blowers, its construction can be made simple.

In the inkjet printer of the present invention, the vents are the vents of air blow nozzles, and the collection ports are the collection ports of collection nozzles, one of a plurality of air blow nozzles is provided outside the box on an upstream side in the conveying direction of the printing medium, the other air blow nozzles are provided inside the box, one of a plurality of collection nozzles is provided outside the box on a downstream side in the conveying direction of the printing medium, and the other collection nozzles are provided inside the box.

According to the inkjet printer, as one air blow nozzle and one collection nozzle are provided outside the box, it is possible to make the box compact.

In the inkjet printer of the present invention, the air blow nozzles each has a vent having a length enough to open throughout a whole area in a width direction of the printing medium and a plurality of inlets spaced apart in a length direction of the vent, the blowout air volume control means can adjust the volume of blowing air to be sent to the respective inlets, the collection nozzles each has a collection port having a length enough to open throughout a whole area in the width direction of the printing medium and a plurality of outlets spaced apart in a length direction of the collection port, and the exhaust blower may suck air from the outlets.

According to the inkjet printer, it is possible to blow out air throughout the whole area in the width direction of the printing medium and the blowout air volume is made uniform throughout the whole area in the width direction. It is possible to suck a uniform volume of air from the whole area in the width direction of the printing medium.

In the inkjet printer of the present invention, there are provided a monitor and a control part, at least a part of the exhaust path that is outside the box is constituted by a steel pipe, an air flow meter may be provided on the steel pipe, and the control part may display an abnormality on the monitor, when an actual measured air volume of the air flow meter falls below a preset reference value of air volume.

According to the inkjet printer, as an operator can recognize that the suction air volume of the exhaust blower is reduced, cleaning and replacement of the filters of ink mist collecting part, inspection and repair of the exhaust blower or the like can be performed.

In the inkjet printer of the present invention, the exhaust path connecting the suction port of the exhaust blower to an the ink mist collecting part may have an inclined shape so as to be higher on the suction port side and ink mist collecting part side and lower at an intermediate part, and a mist storage may be provided in the exhaust path at the lowest portion of the exhaust path.

According to the inkjet printer, as ink mist which is not completely collected at ink mist collecting part and liquefied on a pipe inner wall of the exhaust path can be stored in the mist storage in the exhaust path, liquefied ink mist cannot be sucked by the exhaust blower.

In the inkjet printer of the present invention, the printing medium may be building materials.

Advantageous Effects of the Invention

According to the inkjet printer of the present invention, as the blowout air volume of each vent and the suction air volume of each collection port can be respectively adjusted, ink mist can be collected according to difference in amounts of generated ink mist at each of a plurality of print heads.

As ink mist collecting part liquefies ink mist and collects liquefied ink mist, filters do not get clogged in an early stage, so that it is not necessary to frequently clean and replace the filters.

As ink mist collecting part is provided outside the box, the liquefied ink mist can be easily discharged, and ink mist is not flow inside the box in which the print heads are provided.

As the air blower, the blowout air volume adjusting means, the exhaust blower, ink mist collecting part and suction air volume adjusting mean are provided outside the box, the box can be made compact.

PREFERRED EMBODIMENT OF THE INVENTION

An entire configuration of an inkjet printer according to an embodiment of the present invention will be described with reference to FIG. 1 to FIG. 3.

Figure 1:
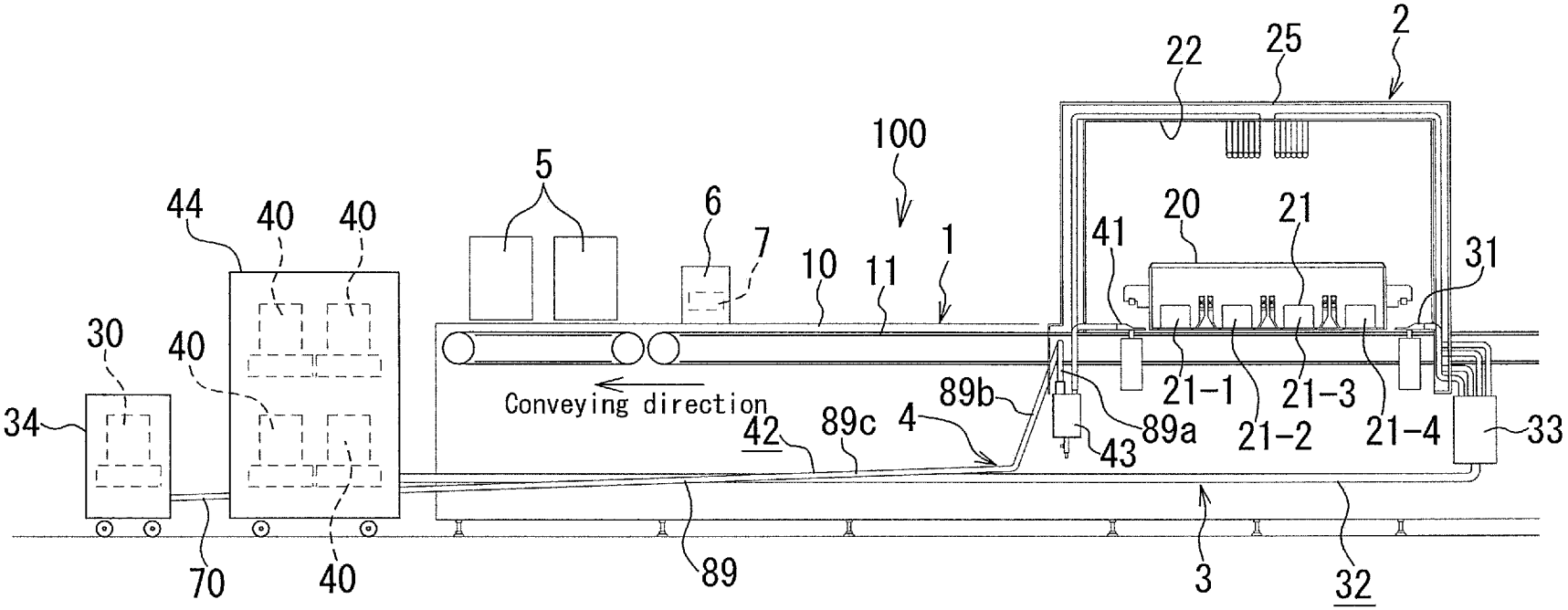
FIG. 1 is an overall front view of an inkjet printer.
Figure 2:
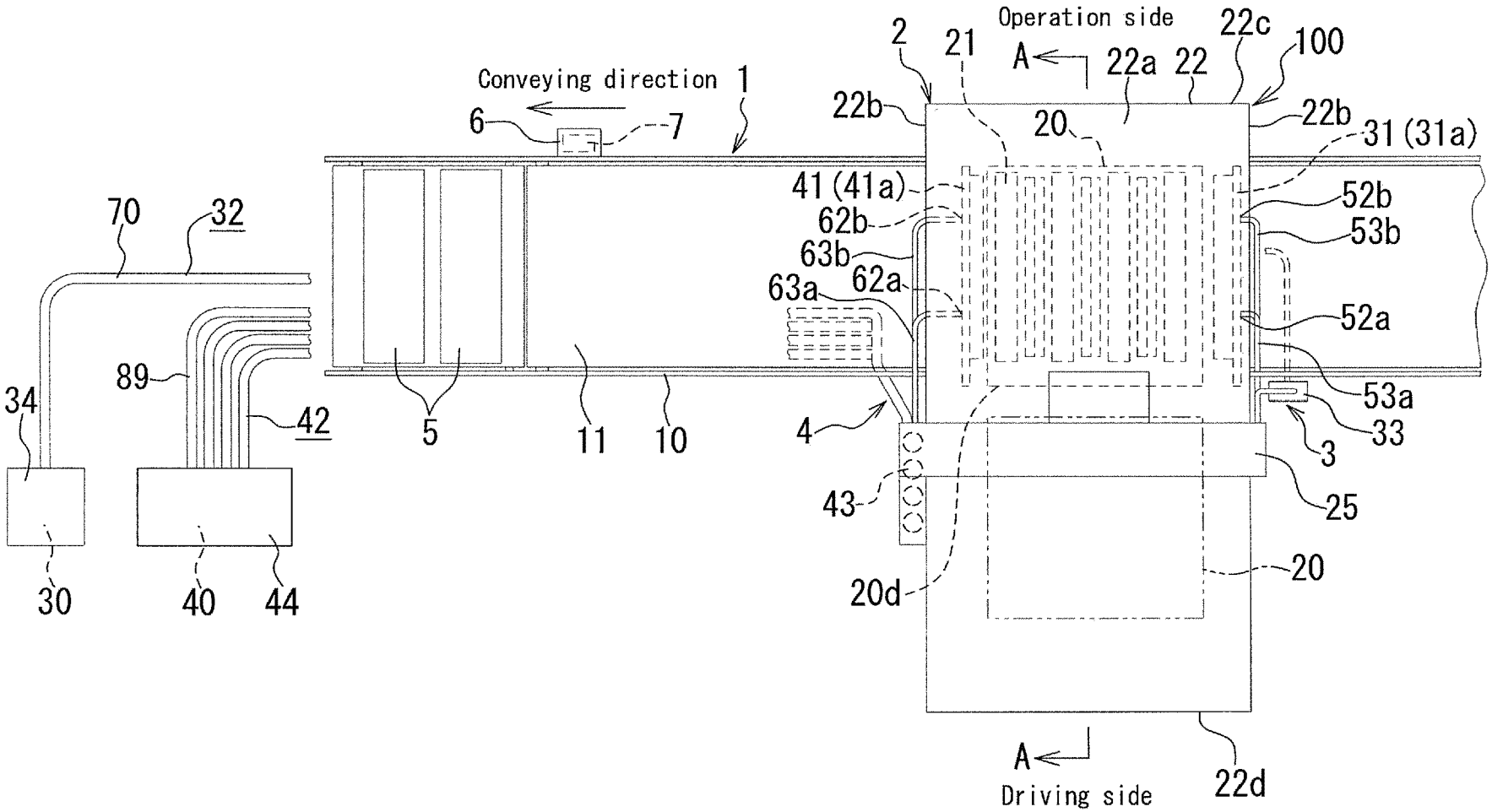
FIG. 2 is an overall plan view of the inkjet printer shown in FIG. 1.
Figure 3:
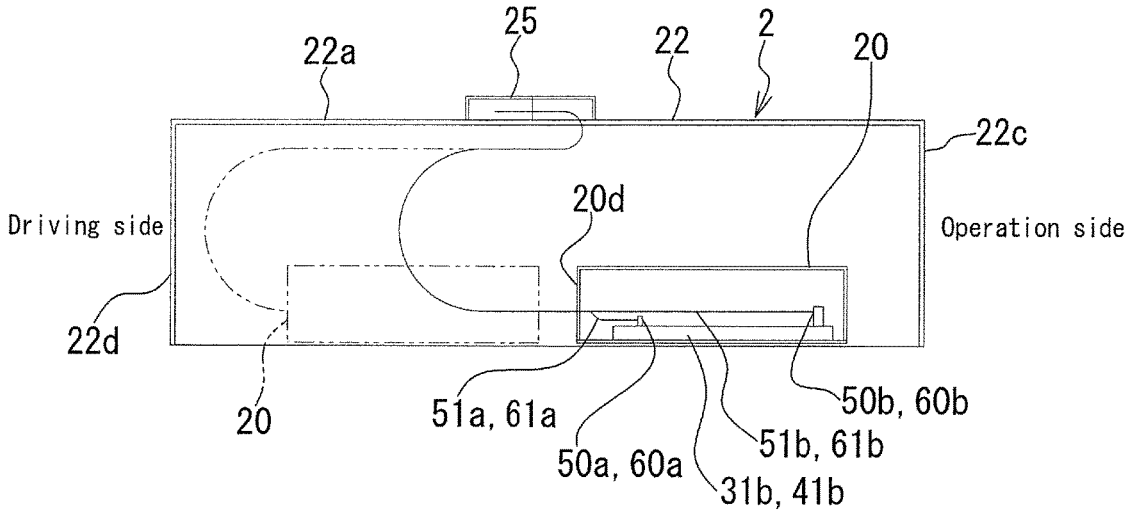
FIG. 3 is a cross-sectional view taking along the line A-A of the inkjet printer shown in FIG. 2.

FIG. 1 is an overall front view of the inkjet printer, FIG. 2 is an overall plan view of the inkjet printer shown in FIG. 1, and FIG. 3 is a cross-sectional view taking along the line A-A of the inkjet printer shown in FIG. 2.

The inkjet printer 100 comprises a conveying part 1 conveying a printing medium (not shown) in a predetermined direction, an inkjet type printing part 2 disposed opposing, at a predetermined distance, to a printing face of the printing medium to be conveyed by the conveying part 1, a blowing part 3 and an exhaust part 4 for collecting ink mist generated at the printing part 2, a drying part 5, a monitor 6 and a control part 7.

The conveying part 1 has a conveying belt 11 provided at a frame 10 and conveys the printing medium by rotationally driving the conveying belt 11.

In the printing part 2, a plurality of print heads 21-1 to 21-4 are provided at intervals in a conveying direction of the printing medium in a box (head box) 20. An image is printed on the printing face of the printing medium using ink of different colors by the respective print heads 21-1 to 21-4.

For example, there are provided four print heads, that is, a first print head 21-1 using black (K) ink, a second print head 21-2 using cyan (C) ink, a third print head 21-3 using magenta (M) ink, and a fourth print head 21-4 using yellow (Y) ink.

A printing is performed (effected) with print heads in order from the fourth to the first print heads 21-4 to 21-1 using yellow (Y), magenta (M), cyan (C) and black (K) ink while conveying the printing medium.

The print head is a line head which has a nozzle face to eject ink opposite to the printing medium throughout a whole area in a width direction (direction perpendicular to the conveying direction) of the printing medium.

For example, the print head is the line head in which a plurality of print head modules (not shown) are disposed zigzag in a direction perpendicular to the conveying direction of the printing medium.

In the followings, description will be made assuming that one side of the direction perpendicular to the conveying direction of the printing medium would be an operation side, and the other side would be a driving side.

A box 20 is provided within a casing 22. The box 20 may be moved in the direction perpendicular to the conveying direction of the printing medium between a printing position (a position indicated by a dot line in FIG. 2, a position indicated by a solid line in FIG. 3) facing the conveying part 1 (conveying belt 11) and a purge position (a position indicated by a dashed-two dotted line in FIG. 2 and FIG. 3) on the driving side.

The casing 22 has an upper face plate 22*a*, side face plates 22*b* on both sides in the conveying direction of the printing medium, an openable door 22*c* on the operation side, and an openable door 22*d* on the driving side, and is formed as a rectangular parallelepiped case.

The casing 22 is attached to the frame 10.

The blowing part 3 blows out air toward a space between each nozzle face of the print heads 21-2 to 21-4 and the printing face of the printing medium from the upstream side of each of the print heads 21-2 to 21-4 in the conveying direction of the printing medium. The blown out air flows toward the downstream side in the conveying direction of the printing medium and causes ink mist generated at the print heads 21-2 to 21-4 to flow toward the downstream side in the conveying direction of the printing medium. A volume of blowout air (blowout air volume) can be adjusted for each print head 21-1 to 21-4.

Each exhaust part 4 sucks ink mist, which is carried by the air blown out from the blowing part 3, together with ambient air from the downstream side in the conveying direction of the printing medium of each print head 21-1 to 21-4.

Each exhaust part 4 collects ink mist contained in the sucked air and exhausts air from which ink mist has been removed to a place distant from the printing part 2. A volume of sucking air (suction air volume) can be adjusted for each print head 21-1 to 21-4.

By virtue of such air flow, ink mist generated at each print head 21-1 to 21-4 is collected. That is, the blowing part 3 and the exhaust part 4 constitute an ink mist collecting apparatus.

In the inkjet printer of the present invention, as the blowout air volume and suction air volume can be respectively adjusted for each print head 21-1 to 21-4, ink mist can be collected according to a difference in the amounts of generated ink mist at each of the plurality of print heads 21-1 to 21-4.

For example, when the amount of generated ink mist is larger, the blowout air volume and the suction air volume are increased. When the amount of generated ink mist is smaller, the blowout air volume and the suction air volume are decreased.

The drying part 5 is provided on the downstream side of the printing part 2 in the conveying direction of the printing medium and dries the printing medium on which a printing has been performed.

Figure 4:
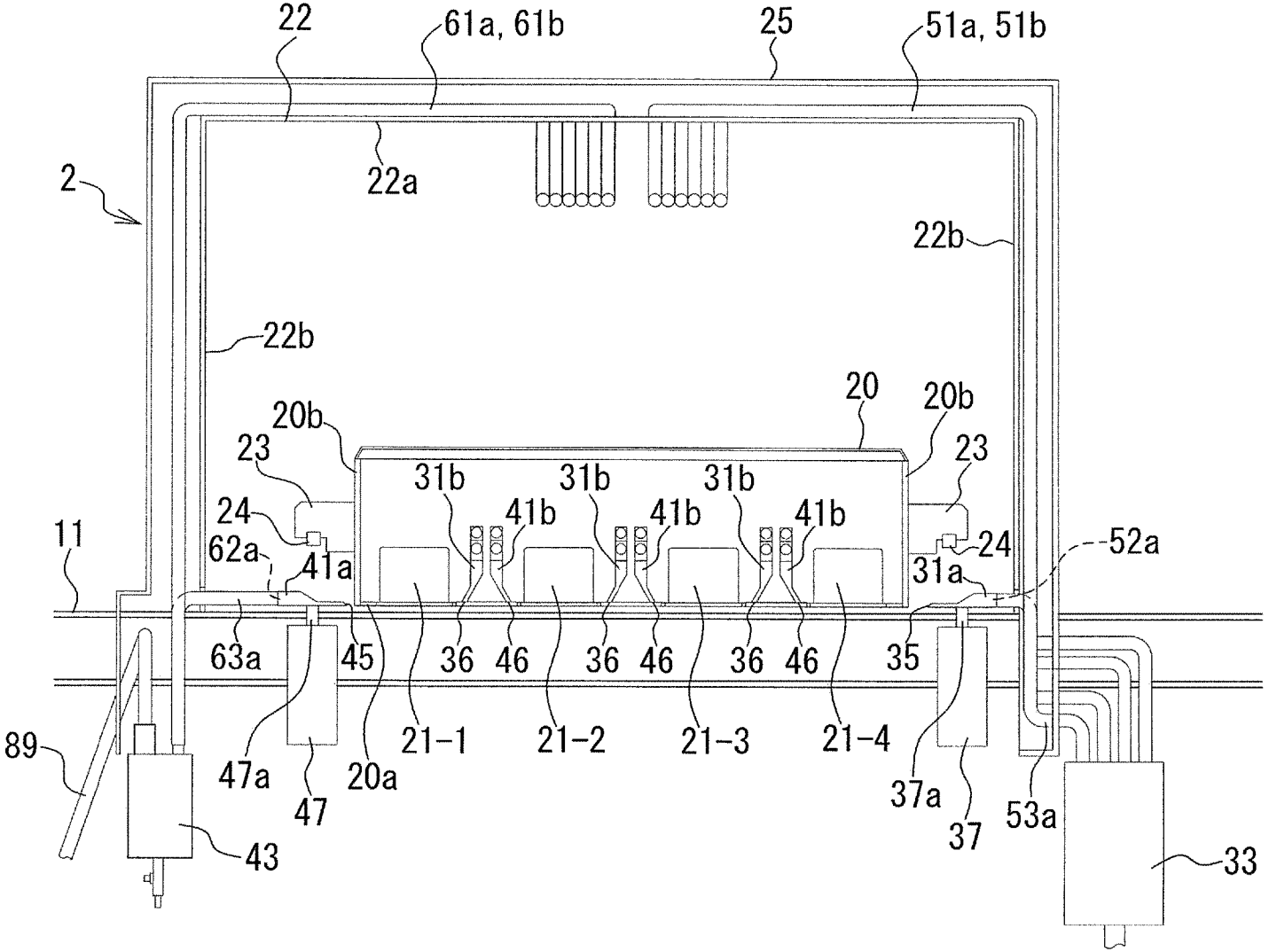
FIG. 4 is an enlarged peripheral view of a printing part of the inkjet printer shown in FIG. 1.

The printing part 2 will be described with reference to FIG. 4. FIG. 4 is an enlarged peripheral view of the printing part 2 of the inkjet printer shown in FIG. 1.

Print heads 21-1 to 21-4 are each attached to a bottom wall 20*a* of the box 20. In the followings, description will be made assuming that a lower surface of the bottom wall 20*a* would be the nozzle face of each print head 21-1 to 21-4.

On side walls 20*b* on both side of the box 20 in the conveying direction of the printing medium, each of sliding members 23 is provided, the sliding member 23 is slidably fitted to a guide rail 24 directed to a direction perpendicular to the conveying direction of the printing medium, so that the box 20 can move between a printing position and a purge position in the direction perpendicular to the conveying direction of the printing medium by a box moving mechanism (not shown).

The box 20 can be vertically moved by a vertically moving mechanism (not shown), that is, the box 20 is moved to an upward position when it is moved between the printing position and the purge position, and it is moved to a downward position when it is at the printing position, so as to set a distance between the nozzle face of the print heads 21-1 to 21-4 and the printing face of the printing medium (head gap) to a predetermined value.

For example, the guide rail 24 can be vertically moved by the vertically moving mechanism (not shown). As the box moving mechanism, such mechanisms are usable as the mechanism which moves the box 20 using a motor and gears, the vertically moving mechanism, a mechanism which vertically moves the guide rail 24 by a cylinder.

As shown in FIG. 1, FIG. 2, FIG. 4 and FIG. 6, the blowing part 3 comprises one air blower 30, a plurality of air blow nozzles 31*a*, 31*b* each provided on the upstream side of each print head 21-1 to 21-4 in the conveying direction of the printing medium, an air blowing path 32 which connects an ejection port 30*a* of the air blower 30 and inlets 50*a*, 50*b* of respective air blow nozzles 31*a*, 31*b* and air adjusting parts 33 each provided in the air blowing path 32.

The air blower 30 is provided in a blower box 34 provided on the downstream side of the printing part 2 in the conveying direction of the printing medium. That is, the air blower 30 is installed outside the box 20.

As shown in FIG. 4, the air blow nozzle part 31 has one air blow nozzle 31*a* outside box which is provided outside the box 20, and three air blow nozzles 31*b* inside box which are provided inside the box 20.

As shown in FIG. 1, FIG. 2 and FIG. 4, the exhaust part 4 comprises the same numbers of exhaust blowers 40 as that of the print heads 21-1 to 21-4, collection nozzles 41*a*, 41*b* each provided on the downstream side of each print head 21-1 to 21-4 in the conveying direction of the printing medium, a plurality of exhaust paths 42 each connecting a suction port of the exhaust blower 40 and outlet of collection nozzle 41*a*, 41*b*, and a plurality of ink mist collecting parts 43 respectively provided in the respective exhaust paths 42.

The exhaust part 4 has four exhaust blowers 40 provided in a blower box 44 provided on the downstream side of the printing part 2 in the conveying direction of the printing medium. That is, the respective exhaust blowers 40 are provided outside the box 20.

Each exhaust blowers 40 is rotationally driven by a motor (not shown), and a rotational speed of the motor can be controlled by inverter-controlling, and the suction air volume (exhaust air volume) of each exhaust blower 40 can be changed.

The four exhaust paths 42 respectively connect suction ports of the four exhaust blowers 40 and outlets of the four collection nozzles 41*a*, 41*b*.

The four exhaust paths 42 are each provided with an ink mist collecting part 43, and ink mist collecting part 43 is provided outside the box 20.

As shown in FIG. 4, the collection nozzle part 41 has one collection nozzle 41*a* provided outside the box 20 and three collection nozzles 41*b* provided inside the box 20.

Three exhaust paths 42 are respectively connected to outlets of the three collection nozzles 41*b* inside box, and the other one exhaust path 42 is connected to the outlet of the collection nozzle 41*a* outside box.

Therefore, by changing the suction air volume of four exhaust blowers 40, the volumes of air (suction air volume) to be sucked by the four collection nozzles 41*a*, 41*b* can be set to be the ones corresponding to the amounts of ink mist generated at the respective print heads 21-1 to 21-4.

The air blow nozzle 31*a* outside box is provided on the upstream side of the printing medium of the box 20 in the conveying direction.

The vent (vent outside the box) 35 of the air blow nozzle 31*a* outside box is opened to a space between the nozzle face of the fourth print head 21-4 which is a print head located on the uppermost stream side in the conveying direction of the printing medium and the printing face of the printing medium, and blows out air to the space between the nozzle face and the printing face from the upstream side to the downstream side in the conveying direction of the printing medium. The air blow nozzles 31*b* inside box are respectively provided on the upstream side of the third print head 21-3 in the conveying direction of the printing medium, which head 21-3 is a print head placed at the second position in the conveying direction of the printing medium, on the upstream side of the second print head 21-2 in the conveying direction of the printing medium, which head 21-2 is a print head placed at the third position in the conveying direction of the printing medium, and on the upstream side of the first print head 21-1 in the conveying direction of the printing medium, which head 21-1 is a print head placed on the lowermost stream side in the conveying direction of the printing medium.

The vents (vents inside box) 36 of the air blow nozzles 31*b* inside box are respectively opened to a space between the nozzle face of the third print head 21-3 and the printing face of the printing medium, a space between the nozzle face of the second print head 21-2 and the printing face of the printing medium, and a space between the nozzle face of the first print head 21-1 and the printing face of the printing medium, and blow out air toward the respective spaces from the upstream side to the downstream side in the conveying direction of the printing medium.

In the air blow nozzle 31*a* outside box, a vertical position (height) of the vent 35 outside the box is adjustable. For example, a vertical moving mechanism 37 is attached to the frame 10 with a bracket (not shown), and a vertically moving member 37*a* is coupled to the air blow nozzle 31*a* outside box.

The vertically moving mechanism 37 moves the member 37*a* with a motor and gears. The vertically moving mechanism 37 can be the one which moves the member 37*a* with a cylinder.

The collection nozzle 41*a* outside box is provided on the downstream side of the box 20 in the conveying direction of the printing medium.

The collection port (collection port outside box) 45 of the collection nozzle 41*a* outside box is opened to a space between the nozzle face of the first print head 21-1 which is a print head located on the lowermost stream side in the conveying direction of the printing medium and the printing face of the printing medium, and sucks ink mist between the nozzle face and the printing face together with the air flowing from the upstream side to the downstream side in the conveying direction of the printing medium.

The collection nozzles 41*b* inside box are respectively provided in the conveying direction of the printing medium on the downstream side of the second print head 21-2 which is a print head positioned in a second place in the conveying direction of the printing medium, on the downstream side in the conveying direction of the printing medium of the third print head 21-3 which is a print head positioned in a third place in the conveying direction of the printing medium, and on the downstream side in the conveying direction of the printing medium of the fourth print head 21-4 which is a print head positioned in the place on uppermost stream side in the conveying direction of the printing medium.

The collection ports (collection ports inside the box) 46 of the collection nozzles 41*b* inside box are respectively opened to a space between the nozzle face of the fourth print head 21-4 and the printing face of the printing medium, a space between the nozzle face of the third print head 21-3 and the printing face of the printing medium, and a space between the nozzle face of the second print head 21-2 and the printing face of the printing medium, and suck ink mist in the respective spaces together with air flowing from the upstream side to the downstream side in the conveying direction of the printing medium.

In the collection nozzle 41*a* outside box, a vertical position (height) of the collection port 45 outside box is adjustable. For example, a vertically moving mechanism 47 is attached to the frame 10 with a bracket (not shown), and a vertically moving member 47*a* is coupled to the collection nozzle 41*a* outside box.

The air blow nozzle 31*a* outside box and the collection nozzle 41*a* outside box are coupled to each other with a coupling member (not shown) so as to vertically move in synchronization with each other.

Ink mist generated at the fourth print head 21-4 is collected by the air blow nozzle 31*a* outside box and the collection nozzle 41*b* inside box respectively provided on the upstream side and the downstream side in the conveying direction of the printing medium of the fourth print head 21-4.

Ink mist generated at the third print head 21-3 is collected by the air blow nozzles 31*b* inside box and the collection nozzle 41*b* inside box respectively provided on the upstream side and the downstream side of the third print head 21-3 in the conveying direction of the printing medium.

Ink mist generated at the second print head 21-2 is collected by the air blow nozzles 31*b* inside box and the collection nozzle 41*b* inside box respectively provided on the upstream side and the downstream side of the printing medium of the second print head 21-2 in the conveying direction.

Ink mist generated at the first print head 21-1 is collected by the air blow nozzles 31*b* inside box and the collection nozzle 41*a* outside box on the upstream side and the downstream side of the printing medium of the first print head 21-1 in the conveying direction.

Figure 5:
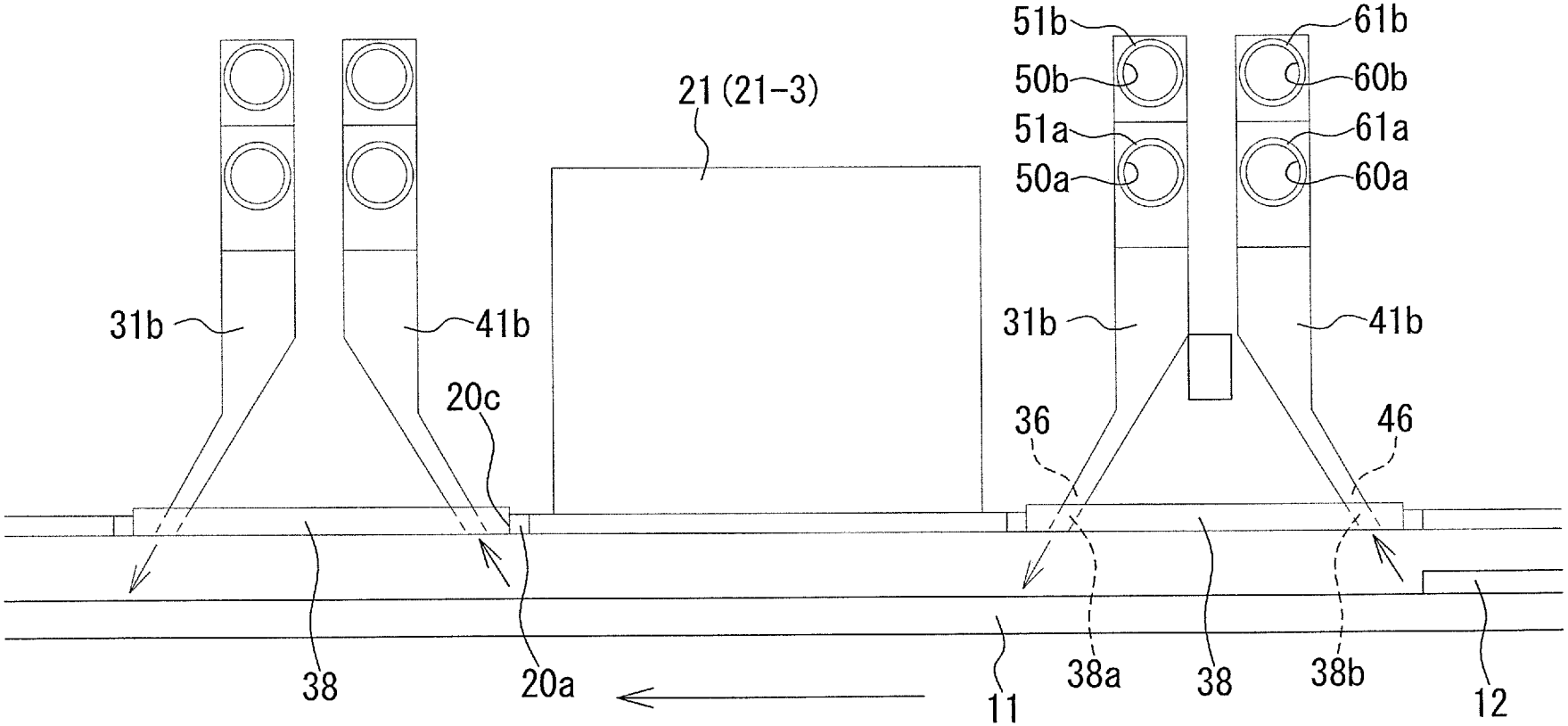
FIG. 5 is an enlarged view of portions where an air blow nozzle in a box and a collection nozzle inside a box are attached shown in FIG. 4.

As shown in FIG. 5, a plate 38 is attached to an opening 20*c* formed in the bottom wall 20*a* of the box 20, to which the air blow nozzles 31*b* inside box and the collection nozzles 41*b* inside box are respectively attached with a bracket (not shown).

The vents 36 inside box are each communicated with first hole 38*a* of the plate 38, and air is blown out from the first hole 38*a*. The collection ports 46 inside box are each configured to be communicated with second hole 38*b* of the plate 38, so that air is sucked from the second hole 38*b*.

The first hole 38*a* is formed obliquely with respect to a vertical direction toward the downstream side in the conveying direction of the printing medium, and air is blown out obliquely downward. The second hole 38*b* is formed obliquely with respect to a vertical direction toward the upstream side in the conveying direction of the printing medium, and air is sucked from obliquely upward.

Accordingly, as a smooth air flow may be formed between each nozzle face of the print head 21-1 to 21-4 and the printing face of the printing medium, ink mist could be smoothly sucked together with air.

The printing medium shown in FIG. 5 may be building materials 12 such as an inner wall material, an outer wall material and a partitioning material for construction.

As the building material 12 has a greater thickness (vertical dimension) as compared to paper, and, moreover, the printing can be made on various kinds of building materials of different thicknesses, the distance between the nozzle face of the print head 21-1 to 21-4 and a printing face of the building material 12 should be set longer.

Therefore, the distance (head gap) between the nozzle face of the print head 21-1 to 21-4 and the printing face of the building material 12 may be increased, and, moreover, droplets of ink for printing may be increased, then, the amount of generated ink mist becomes larger as compared to the printing medium of paper.

According to the inkjet printer of such embodiment, the printing is performed in a following manner when the printing medium is the building material 12.

Height of the vent 35 outside box and the collection port 45 outside box may be adjusted to a height appropriate for the thickness of the building material 12 by vertically moving the air blow nozzle 31*a* outside box and the collection nozzle 41*a* outside box for adjustment. Height of the vent 36 inside box and the collection ports 46 inside box may be adjusted to a height appropriate for the thickness of the building material 12 by vertically moving the air blow nozzles 31*b* inside box and the collection nozzles 41*b* inside box for adjustment.

Blowout air volume from the vents and suction air volume from the collection ports shall be air volumes corresponding to the distance between the nozzle face of the print heads and the printing face of the building material and the amount of ink used.

Therefore, even when printing is made on the building material 12 of different thicknesses, generated ink mist could be sufficiently collected.

As shown in FIG. 5, the air blow nozzles 31*b* inside box each has a first inlet 50*a* and a second inlet 50*b* on an upper surface, a first air blowing pipe 51*a* inside box is connected to the first inlet 50*a*, and a second air blowing pipe 51*b* inside box is connected to the second inlet 50*b*.

Air flowed into the nozzles from the first and the second inlets 50*a*, 50*b* is blown off from the vents 36 inside box.

The collection nozzles 41*b* inside box each has a first outlet 60*a* and a second outlet 60*b* on an upper surface, a first exhaust pipe 61*a* inside box is connected to the first outlet 60*a*, and a second exhaust pipe 61*b* inside box is connected to the second outlet 60*b*.

Air inside the nozzle is sucked through the first and the second outlets 60*a* and 60*b* such that air is sucked through the collection port 46 inside box.

As shown in FIG. 3, the first inlet 50*a* and the first outlet 60*a* are located on a driving side in a length direction of the air blow nozzle 31*b* inside box and the collection nozzle 41*b* inside box, and the second inlet 50*b* and the second outlet 60*b* are located on an operation side in a length direction of the air blow nozzle 31*b* inside box and the collection nozzle 41*b* inside box.

The first and the second air blowing pipes 51*a*, 51*b* inside box and the first and the second exhaust pipes 61*a*, 61*b* inside box are flexible pipes formed of a material resistant to ink, and the respective pipes penetrate through a side wall 20*d* on the driving side of the box 20 to be projected inside the casing 22, are curved in a substantially C shape in the direction perpendicular to the conveying direction of the printing medium inside the casing 22 and are projected outside from an upper face plate 22*a* of the casing 22.

A portion of the pipes which is curved in a C shape is supported and guided by CABLEVEYOR in katakana (registered trademark) (not shown), so that each pipe is smoothly moved when the box 20 is moved between the printing position and the purge position.

As shown in FIG. 4, three first, second air blowing pipes 51*a*, 51*b* inside box projected out the casing 22 are disposed along the upper face plate 22*a* of the casing 22 to a side face plate 22*b* on the upstream side in the conveying direction of the printing medium, and are connected to air adjusting parts 33.

Three first, second exhaust pipes 61*a*, 61*b* inside box projected outwardly from the casing 22 are disposed along the upper face plate 22*a* of the casing 22 to the side face plate 22*b* on the downstream side in the conveying direction of the printing medium, and are respectively connected to the three ink mist collecting parts 43.

A pipe cover 25 is attached to the upper face plate 22*a* and the both side face plates 22*b* of the casing 22 to protect the pipes.

As shown in FIG. 2, the air blow nozzle 31*a* outside box has a first inlet 52*a* located closer to the driving side in the length direction and a second inlet 52*b* located closer to the operation side in the length direction. A first air blowing pipe 53*a* outside box is connected to the first inlet 52*a*, and a second air blowing pipe 53*b* outside box is connected to the second inlet 52*b*.

The first and the second air blowing pipes 53*a* and 53*b* outside box are connected to the air adjusting parts 33.

The collection nozzle 41*a* outside box has a first outlet 62*a* located closer to the driving side in the length direction and a second outlet 62*b* located closer to the operation side in the length direction. A first exhaust pipe 63*a* outside box is connected to the first outlet 62*a*, and a second exhaust pipe 63*b* outside box is connected to the second outlet 62*b*.

The first and the second exhaust pipes 63*a*, 63*b* outside box are each connected to one and another ink mist collecting part 43.

The first and the second air blowing pipes 53*a*, 53*b* outside box and the first and the second exhaust pipes 63*a*, 63*b* outside box are flexible pipes formed of a material resistant to ink.

As the air blow nozzles 31*a*, 31*b* each has a length over the whole area in a width direction of the printing medium, and the vents 35, 36 are opened throughout the substantially whole area (the whole area in the width direction of the printing medium) in the length direction of the air blow nozzles 31*a*, 31*b*, it is possible to blow out air to the whole area in the width direction on the printing face of the printing medium. Here, the width direction is the direction perpendicular to the conveying direction of the printing medium.

As air flows into each air blow nozzle 31*a*, 31*b* from an inlet closer to the operation side in the length direction and from an inlet closer to the driving side in the length direction, it is possible to blow out air almost evenly from the whole area of the vents 35, 36 in the length direction. Therefore, it is possible to evenly blow out air from the vents 35, 36 over the whole area of the printing face of the printing medium in the width direction.

In contrast, when air flows from only one inlet, a larger volume of air would blow out from a part of the vent near the inlet, and only a smaller volume of air would blow out from a part distant from the inlet.

As the collection nozzle 41*a*, 41*b* each has the same length as that of each air blow nozzle 31*a*, 31*b*, and the collection ports 45, 46 are each opened over substantially the whole area (the whole area in the width direction of the printing medium) of each collection nozzle 41*a*, 41*b* in the length direction, it is possible to suck air from the whole area in the width direction of the printing medium.

As air inside the collection nozzles 41*a*, 41*b* is sucked from the outlet closer to the operation side in the length direction and from the outlet closer to the driving side in the length direction, it is possible to uniformly suck air from the whole area of the collection ports 45, 46 in the length direction. Therefore, it is possible to evenly suck air from the whole area in the width direction of the printing face of the printing medium through the collection ports 45, 46.

In contact, when air is sucked from only one outlet, a larger volume of air would be sucked from a part of the collection ports 45 and 46 near the outlet, and only a smaller volume of air would be sucked from a part distant from the outlet.

Among four air blow nozzles 31*a*, 31*b* and four collection nozzles 41*a*, 41*b*, respective three nozzles (nozzles inside box) 31*b*, 41*b* are provided inside the box 20, and respective one nozzle (nozzle outside box) 31*a*, 41*a* are provided outside the box 20, then, the box 20 can be made compact as compared to a case where respective four nozzles are provided inside the box 20.

As the nozzles 31*a*, 41*a* provided outside the box 20 are irremovable in the direction perpendicular to the conveying direction of the printing medium together with the box 20, pipes to the nozzles 31*a*, 41*a* can be made simple.

Moreover, while the nozzles provided inside box 20 are usually each formed in a vertically long and complicated shape to reduce a size in the conveying direction of the printing medium, the nozzles to be provided outside box 20 can be each formed in a laterally long and simple shape, because the nozzles provided outside box 20 are irrelevant to the space in the conveying direction of the printing medium of the box 20.

Note that, while not shown, four air blow nozzles 31*a*, 31*b* and four collection nozzles 41*a*, 41*b* may be respectively provided inside the box 20.

Figure 6:
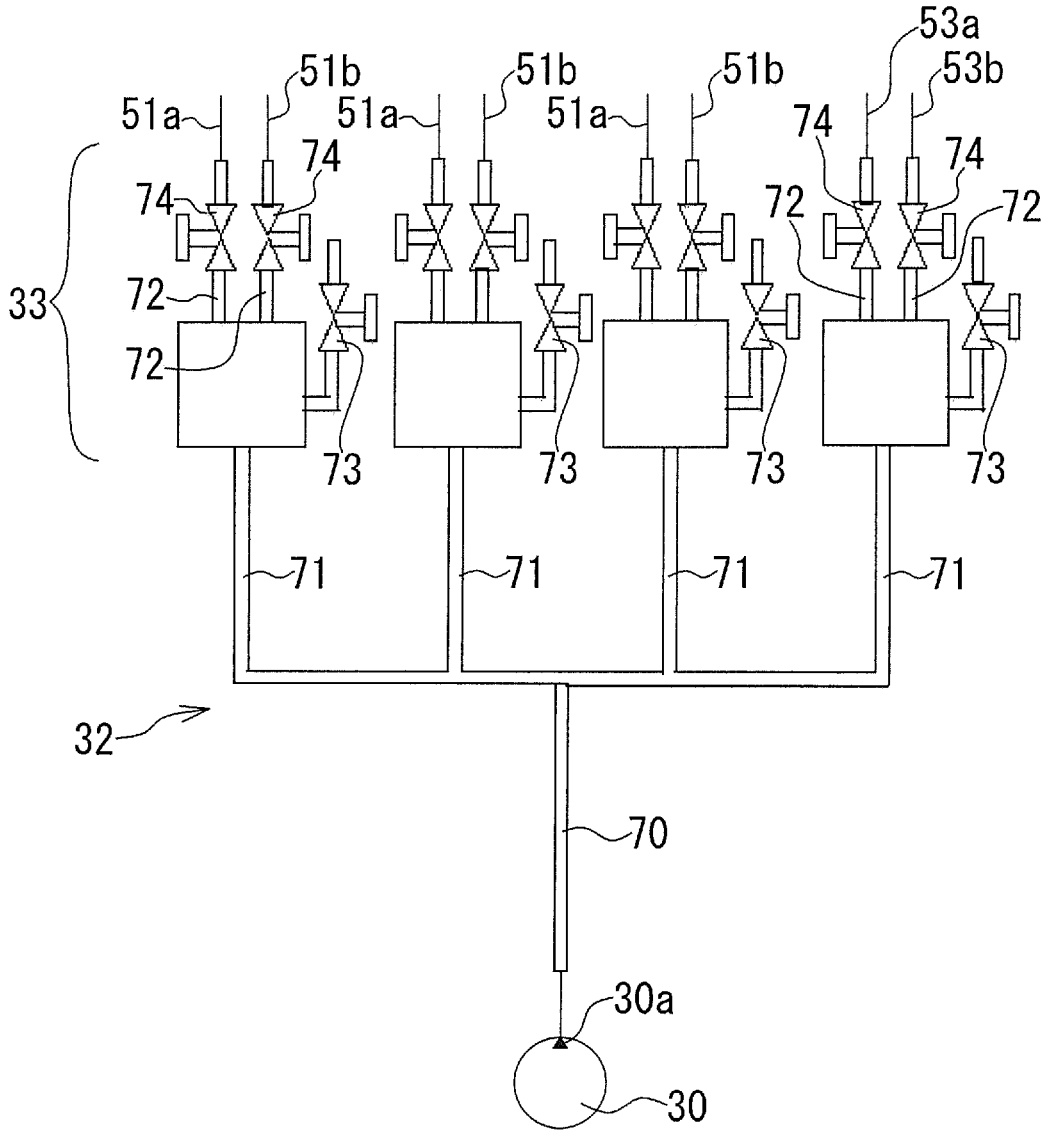
FIG. 6 is a schematic explanatory diagram of an air adjusting part.

The air adjusting parts 33 will be described with reference to FIG. 6. FIG. 6 is a schematic explanatory diagram of the air adjusting parts.

A main air blowing pipe 70 connected to an ejection port 30*a* of the air blower 30 is branched into the same number of sub-air blowing pipes 71 as that of the print heads 21-1 to 21-4. For example, the main air blowing pipe 70 is branched into four sub-air blowing pipes 71.

The sub-air blowing pipes 71 are each branched into the same plural number of air blowing pipes 72 as that of inlets 50*a*, 50*b* of one of air blow nozzles 31*a*, 31*b*. For example, the sub-air blowing pipes 71 are each branched into two air blowing pipes 72.

Leak amount control valves 73 are each provided on an upstream side (on the main air blowing pipe 70 side) of a branched part of the sub-air blowing pipe 71 in an airflow direction.

The leak amount control valve 73 adjusts a volume of air (blowing volume) flowing in the sub-air blowing pipes 71 by leaking a part of the air flowing into the sub-air blowing pipe 71 through the main air blowing pipe 70 from the air blower 30. By performing an adjusting operation of the leak amount control valves 73, volumes of air blown to the inlets of the respective air blow nozzles 31*a*, 31*b* can be adjusted.

Flow regulation valves 74 are each provided in each air blowing pipe 72.

The flow regulation valve 74 is a valve which adjusts a flow rate of outflow to be lower than a flow rate of inflow. By performing adjusting operation of one flow regulation valve 74, an air volume to be sent to one inlet of one air blow nozzle 31 can be controlled.

The first air blowing pipes 51*a* inside box and the second air blowing pipes 51*b* inside box are respectively connected to outflow sides of the respective two flow regulation valves 74 which are continuous to one of the three sub-air blowing pipes 71.

The first air blowing pipe 53*a* outside box and the second air blowing pipe 53*b* outside box are respectively connected to the outflow sides of the two flow regulation valves 74 which are continuous to the other one sub-air blowing pipe 71.

The main air blowing pipe 70, the sub-air blowing pipes 71 and the air blowing pipes 72 are flexible pipes formed of a material resistant to ink. These air blowing pipes 70, 71 and 72, the first and the second air blowing pipes 51*a* and 51*b* inside box, and the first and the second air blowing pipes 53*a* and 53*b* outside box constitute the air blowing path 32.

That is, in the air blowing path 32, there are provided paths 71 branched into the same number as that of the print heads 21-1 to 21-4 on the downstream side in an air ejection direction of the air blower 30, and there are provided the leak amount control valves 73 respectively at the respective branched portions, each of the branched paths 71 in turn is branched into two paths 51*a*, 51*b*, and the branched paths 51*a*, 51*b* are connected to inlets 50*a*, 50*b* of the respective air blow nozzles 31*a*, 31*b* via the flow regulation valves 74.

The air adjusting part 33 can respectively adjust the air volume (air blow volume) to be sent to the inlets 50*a*, 50*b* of one air blow nozzle 31 by performing the adjusting operations of one leak amount control valve 73 and the two flow regulation valves 74 respectively.

Therefore, it is possible to set the outlet air volume of each vent 35, 36 to an air volume according to the amount of ink mist or the like, generated at the respective print heads 21-1 to 21-4 by adjusting the air volume to the respective air blow nozzles 31*a*, 31*b*.

For example, under such condition that one leak amount control valve 73 connected to the sub-air blowing pipe 71 and two flow regulation valves 74 are fully opened (the maximum air volume level), the respective valves 73 and 74 are operated to control the volumes of air flowing into the first and the second inlets 50*a*, 50*b* so as to be at preset respective outlet air volumes, while measuring air volumes flowing into the first inlet 50*a* and the second inlet 50*b* of each air blow nozzle 31*a*, 31*b*, as a result, the outlet air volume corresponding to the amount of ink mist generated at each print heads 21-1 to 21-4 may be uniformly blown out from the vent 35, 36 of each air blow nozzle 31*a*, 31*b* over the entire length of the vent 35, 36 in the longitudinal direction.

That is, even if the air volume is once set by the leak amount control valve 73, as the length of the first air blowing pipe 51*a* inside box differs from the length of the second air blowing pipe 51*b* inside box, the air volume at the first inlet 50*a* differs from the air volume at the second inlet 50*b*.

On this account, by adjusting the flow regulation valves 74, the air volume at the first inlet 50*a* of the air blow nozzle 31*b* inside box is made equal to the air volume at the second inlet 50*b*, and the air volume at the first inlet 52*a* of the air blow nozzle 31*a* outside box is made equal to the air volume at the second inlet 52*b*.

If there is provided one inlet of the air blow nozzle 31, it is enough to connect the sub-air blowing pipe 71 to the inlet without providing the flow regulation valve 74.

That is, the air volume to be sent to each air blow nozzle 31*a*, 31*b* can be adjusted by the air adjusting parts 33, so that the air volume (blowout air volumes) blown out from each vent 35, 36 may correspond to the amount of ink mist generated at the respective print heads 21-1 to 21-4 or the like.

An air volume per unit time may be changed by controlling the rotational speed of the air blower 30, which may be controlled through an inverter-control of a motor (not shown) for rotating the air blower 30.

Ink mist collecting parts 43 each collects ink mist from air containing ink mist sucked by each collection nozzle 41*a*, 41*b* and exhausts air from which ink mist has been removed from each exhaust blower 40.

Figure 7:
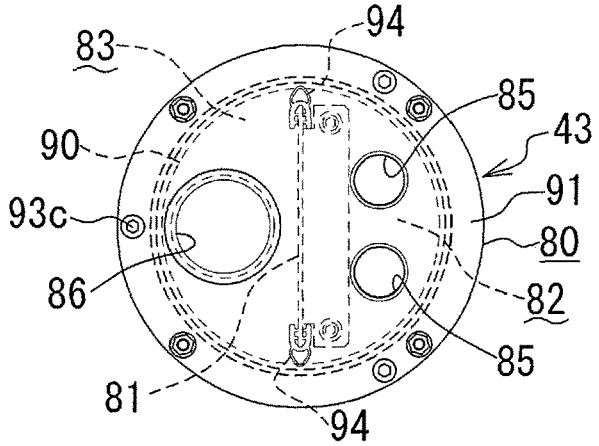
FIG. 7 is an enlarged plan view of an ink mist collecting part shown in FIG. 2.
Figure 8:
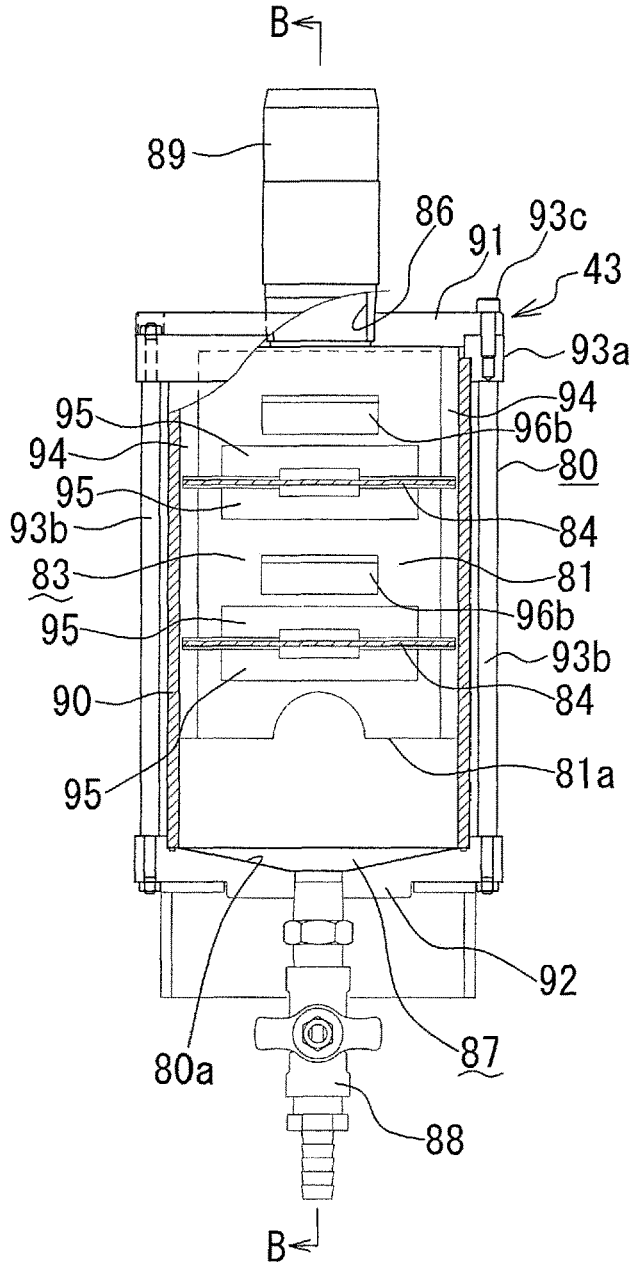
FIG. 8 is a partially cut left side view of ink mist collecting part shown in FIG. 7.
Figure 9:
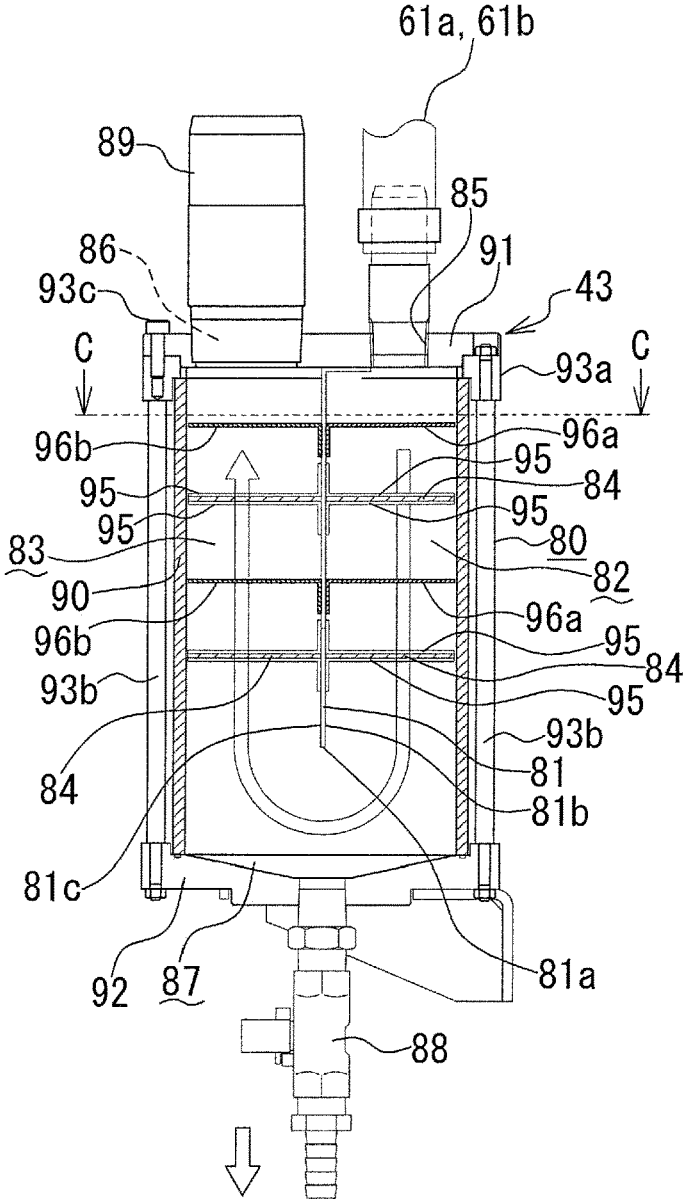
FIG. 9 is a cross-sectional view taking along the line B-B of ink mist collecting part shown in FIG. 8.
Figure 10:
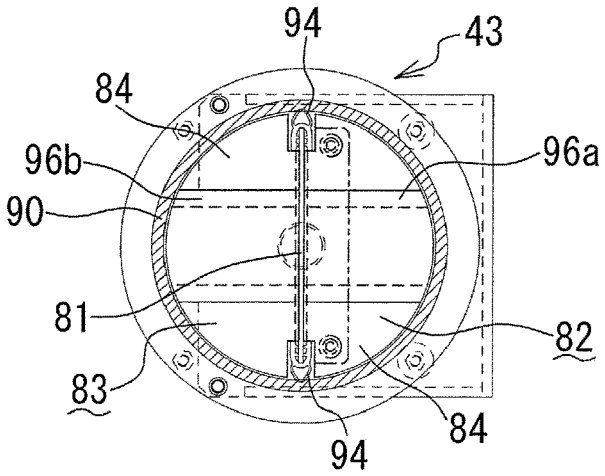
FIG. 10 is a cross-sectional view taking along the line C-C of ink mist collecting part shown in FIG. 9.

The ink mist collecting part 43 will be described with reference to FIG. 7 to FIG. 10. FIG. 7 is an enlarged plan view of ink mist collecting part shown in FIG. 2, FIG. 8 is a partially cut left side view of ink mist collecting part shown in FIG. 7, FIG. 9 is a cross-sectional view taken along the line B-B of ink mist collecting part shown in FIG. 8, and FIG. 10 is a cross-sectional view taken along the line C-C of ink mist collecting part shown in FIG. 9.

Ink mist collecting parts 43 each has a body 80. The body 80 is hollow and a partition plate 81 partitions inside the body 80 into an inflow chamber 82 and an outflow chamber 83. A lower part of the inflow chamber 82 and a lower part of the outflow chamber 83 respectively are opened to an inner bottom surface 80*a* of the body 80 and are communicated with each other.

Two filters 84 are respectively provided at vertical intervals in the inflow chamber 82 and the outflow chamber 83. The filters 84 are each made of metal, for example and wire meshes made of stainless steel.

At the upper part of the body 80, two inlet holes 85 opened to an upper part of the inflow chamber 82, and one outlet hole 86 opened to an upper part of the outflow chamber 83, are provided.

The inner bottom surface 80*a* of the body 80 and a lower end surface 81*a* of the partition plate 81 are vertically spaced each other.

The inner bottom surface 80*a* of the body 80 is recessed in a funnel shape, and the lower end face 81*a* of the partition plate 81 is separated from the inner bottom surface 80*a*, whereby a lower part inside the body 80 constitutes a mist storage tank 87. A lower opening of the inflow chamber 82 and a lower opening of the outflow chamber 83 are located at the upper part of the mist storage tank 87.

A drain valve 88 is provided at the mist storage tank 87.

The mist storage tank 87 may be provided separately from the body 80, and the inner bottom surface 80*a* of the body 80 may be communicated with the mist storage tank 87 with a pipe, or the like.

To the two inlet holes 85 of one ink mist collecting part 43, either one of the first and the second exhaust pipes 61*a* and 61*b* inside box which are connected to the first and the second outlets 60*a* and 60*b* of the one collection nozzle 41*b* inside box, or the first and the second exhaust pipes 63*a* and 63*b* outside box which are connected to the first and the second outlets 62*a* and 62*b* of the collection nozzle 41*b* outside box are connected.

A main exhaust pipe 89 is connected to the outlet hole 86. The main exhaust pipe 89 is connected to a suction port of one exhaust blower 40 (see FIG. 1).

The main exhaust pipe 89 is a flexible pipe made of a material resistant to ink, and one main exhaust pipe 89 and the first and the second exhaust pipes 61*a* and 61*b* inside box constitute the exhaust path 42, and one main exhaust pipe 89 and each one of the first and the second exhaust pipes 63*a* and 63*b* outside the box constitute the exhaust path 42 (see FIG. 1).

That is, the ink mist collecting part 43 is provided in each exhaust path 42 of four exhaust paths 42 to which the suction ports of four exhaust blowers 40 and outlets of four collection nozzles 41*a*, 41*b* are connected.

Therefore, air sucked from collection ports 45 and 46 of each of the four collection nozzles 41*a*, 42*b* respectively flows into the inflow chambers 82 of ink mist collecting parts 43, passes through the filters 84, and is sucked by one exhaust blower 40 via one main exhaust pipe 89 and is exhausted.

Ink mist collecting part 43 collects ink mist as in a following manner.

Ink mist is sucked from the collection ports 45, 46 together with air by rotating the exhaust blower 40 to suck air from the suction port 40*a* (see FIG. 1).

As shown in FIG. 9, the air containing ink mist sucked from the collection ports 45 and 46 flows from the upper part to the lower part of the inflow chamber 82, and after having flown to the lower part of the inflow chamber 82, flows to the upper part of the outflow chamber 83, ink mist is liquefied while the air containing ink mist passes through the filters 84.

The liquefied ink mist flows down by gravity and is stored in the mist storage tank 87.

As the filters 84 are horizontally attached across the partition plate 81 and an inner peripheral surface of the body 80, the air containing ink mist passes through the whole area of the filters 84, so that, ink mist can be liquefied by using the whole area of the filters 84. Moreover, the air containing ink mist passes through the filters 84 in the inflow chamber 82 from upward to downward and further passes through the filters 84 in the outflow chamber 83 from downward to upward, thus, ink mist contained in the air can be reliably liquefied.

As the mist storage tank 87 is located below the lower opening of the inflow chamber 82 and the lower opening of the outflow chamber 83, the liquefied ink mist may flow down from the whole area of the filters 84 without being adhered to the inner peripheral surface of the body 80, and may be stored in the mist storage tank 87.

Therefore, ink mist contained in the air can be efficiently collected in the mist storage tank 87.

The air does not flow along the inner bottom surface 80*a* of the body 80, because the air containing ink mist flows from the lower opening of the inflow chamber 82 to the lower opening of the outflow chamber 83.

Therefore, the liquefied ink mist stored in the mist storage tank 87 is not sucked up to the outflow chamber 83 by the flow of air containing ink mist flowing inside the body 80, and the liquefied ink mist stored in the mist storage tank 87 is not sucked in the exhaust blower 40.

The air from which liquefied ink mist, which is liquefied while air passes through the filters 84, is removed is exhausted outside from an exhaust port of the exhaust blower 40.

As the liquefied ink mist stored in the mist storage tank 87 can be exhausted to the outside the tank by opening the drain valve 88, the liquefied ink mist can be exhausted outside the tank before a large amount of the liquefied ink mist has been stored in the mist storage tank 87. As a result, ink mist may be prevented from being un-collectable, breaking-down of the exhaust blower 40 etc. can be prevented.

That is, when a large amount of liquefied ink mist is stored in the mist storage tank 87, and clearance between the lower end face 81*a* of the partition plate 81 and liquid level of the liquefied ink mist is eliminated, the air containing ink mist cannot flow into the outflow chamber 83 from the inflow chamber 82 and cannot pass through inside of the body 80, thus ink mist cannot be sufficiently collected and finally cannot be collected.

Further, the stored liquefied ink mist is sucked into the exhaust blower 40, which would lead to a failure of the exhaust blower 40.

As ink mist collecting part 43 liquefies ink mist while the air containing ink mist passes through the filters 84, stores and collects the liquefied ink mist in the mist storage tank 87, the filters 84 do not get clogged in an early stage, and it is not necessary to frequently clean and replace the filters 84.

As ink mist collecting part 43 is provided outside the box 20, the liquefied ink mist stored in the mist storage tank 87 can be easily discharged, and as ink mist leaked from ink mist collecting part 43 flows to the atmosphere, ink mist collected in the box 20 is prevented from adversely affecting on printing operation. Moreover, the box 20 can be made compact.

As ink mist collecting parts 43 are each provided at a position distant from the exhaust blower 40 and close to the collection nozzles 41*a*, 41*b*, contamination inside the exhaust paths 42 due to ink mist collected together with air can be minimized.

The body 80 of ink mist collecting part 43 has a cylindrical shape with a cylindrical body 90, a top cover 91 and a bottom plate 92. The cylindrical body 90 is made of a glass material considering resistance to ink (ink mist), and a film (not shown) which is opaque to ultraviolet lay is wound around the outer peripheral surface to prevent curing of ink (ink mist).

The cylindrical body is formed by a press ring 93*a* provided at an upper end part of the cylindrical body 90, a lower end part of the cylindrical body 90 abutting on a bottom plate 92, and the press ring 93*a* and the bottom plate 92 fastened and fixed with a stay 93*b* being disposed therebetween, so that excessive force is not applied on the cylindrical body 90 which is made of a glass material.

The top cover 91 is secured to the press ring 93*a* by bolts 93*c*, and the top cover 92 can be removed by loosening the bolts 93*c*.

The partition plate 81 is attached to the lower face of the top cover 91. A width dimension of the partition plate 81 is smaller than an inner diameter of the cylindrical body 90, and a seal material 94 such as rubber is attached on both sides in a width direction of the partition plate 81.

The seal material 94 is brought into contact with an inner peripheral surface of the cylindrical body 90 to seal between the partition plate 81 and the inner peripheral surface of the cylindrical body 90.

The filter 84 is held between a pair of upper and lower support plates 95 respectively attached to one side face 81*b* and the other side face 81*c* of the partition plate 81.

An air baffle plate 96*a* on an inflow side to which air flowing in the inflow chamber 82 is blown is attached to the one side face 81*b* of the partition plate 81, and an air baffle plate 96*b* on an outflow side to which air flowing in the outflow chamber 83 is blown is attached to the other side face 81*c* of the partition plate 81.

By removing the top cover 91 from the cylindrical body 90 (press ring 93*a*) and moving the top cover 91 upward while sliding the seal materials 94 along the inner peripheral surface of the cylindrical body 90, the filter 84 can be taken out from the body 80 together with the partition plate 81.

Therefore, the filter 84 can be easily taken out from the body 80, and the filter 84 can be cleaned or replaced outside the body 80, so that cleaning and replacement work may be facilitated.

Moreover, as air always passes through the filter 84 in such a way that no air flows into the inflow chamber 82 and the outflow chamber 83 through spaces between the inner peripheral surface of the cylindrical body 90 and both side faces in the width direction of the partition plate 81, ink mist contained in the air can be reliably liquefied.

Still further, air flowing in the inflow chamber 82 flows toward the filter 84 while the air is blown off to the air baffle plate 96*a* on the inflow side and thereby diffused in a direction of the inner peripheral surface of the cylindrical body 90, and air flowing in the outflow chamber 83 also flows toward the filter 84 while the air is blown off to the air baffle plate 96*b* on the outflow side and diffused in a similar manner. Therefore, ink mist contained in the air can be efficiently liquefied.

As shown in FIG. 1, the four main exhaust pipes 89 each has a first pipe portion 89*a* which is directed upward from the outlet hole 86 of ink mist collecting part 43, a second pipe portion 89*b* which is directed obliquely downward from an upper end portion of the first pipe portion 89*a*, and a third pipe portion 89*c* which is directed to the exhaust blower 40 from a lower end portion of the second pipe portion 89*b*.

The third pipe portion 89*c* is inclined downward with respect to a horizontal direction, and a portion on the exhaust blower 40 side of the third pipe portion 89*c* is lower than a portion on the second pipe portion 89*b* side. While the third pipe portion 89*c* is preferably inclined downward, the third pipe portion 89*c* may be horizontal. That is, it is enough that a portion on the exhaust blower 40 side of the third pipe portion 89*c* is not higher than a portion on ink mist collecting part 43 side.

Figure 11:
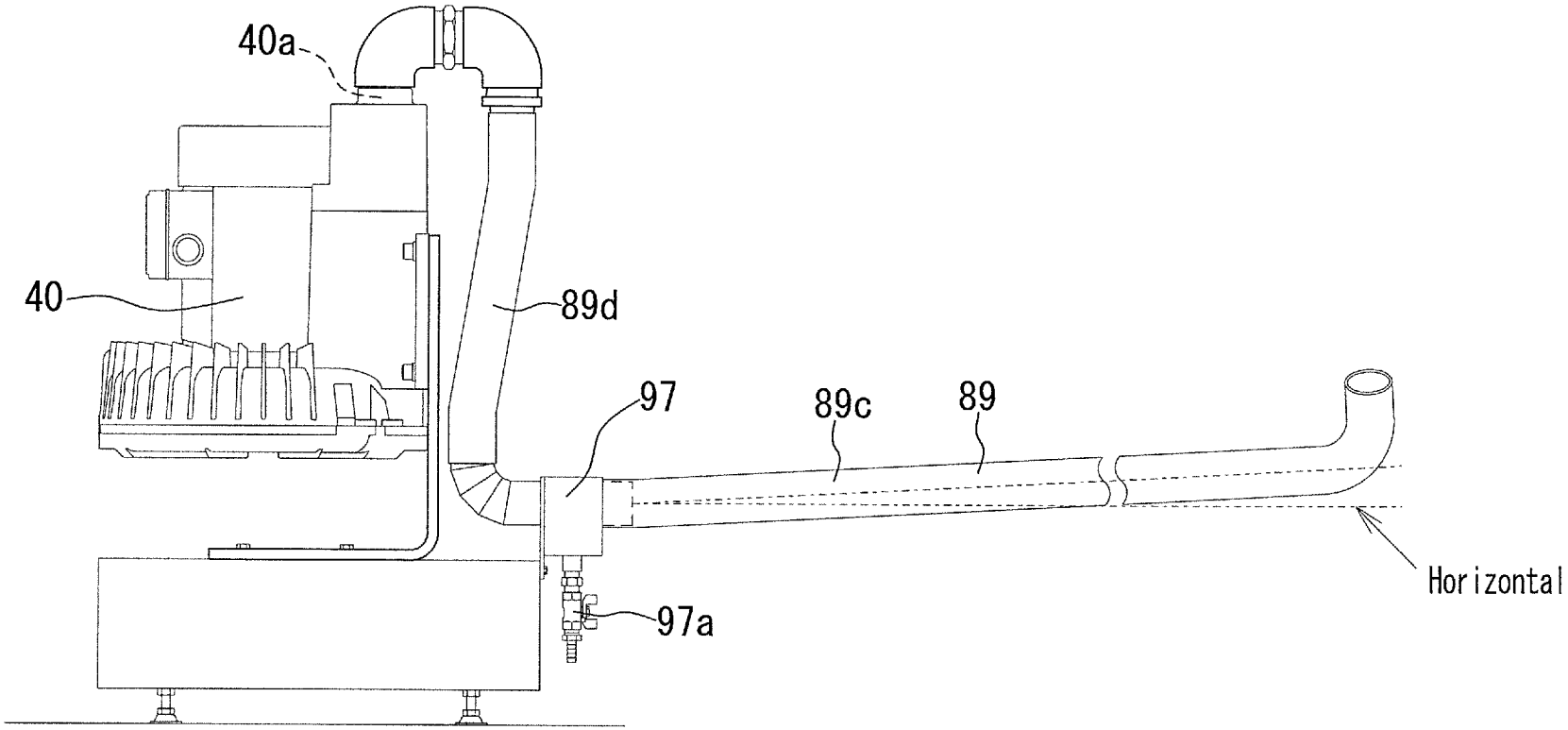
FIG. 11 is a front view of a portion of an exhaust path closer to an exhaust blower.

As shown in FIG. 11, an upward fourth pipe portion 89*d* which is connected to the suction port 40*a* of the exhaust blower 40 is connected to the exhaust blower 40 side of the third pipe portion 89*c*.

The fourth pipe portion 89*d*, the third pipe portion 89*c*, the second pipe portion 89*b* and the first pipe portion 89*a* constitute the main exhaust pipe 89.

The main exhaust pipe 89 is located at the lowest position at the continuous portion of the fourth pipe portion 89*d* and the third pipe portion 89*c*. A mist storage (trap) 97 in the exhaust path is provided at that lowest position. The mist storage 97 in the exhaust path comprises a drain valve 97*a*.

Any ink mist which cannot be collected at ink mist collecting part 43 is liquefied inside the main exhaust pipe 89 and would be adhered to the pipe inner wall. The adhered liquefied ink mist would flow toward the exhaust blower 40 together with flow of air and may be stored in the mist storage 97 within the exhaust path.

The liquefied ink mist stored in the mist storage 97 in the exhaust path may be discharged to the outside by operating the drain valve 97*a* to open.

As the mist storage 97 in the exhaust path is located at the lowest position in the main exhaust pipe 89 (exhaust path), the liquefied ink mist adhered to the pipe inner wall of the main exhaust pipe 89 easily flows to the mist storage 97 in the exhaust path, so that the liquefied ink mist in the mist storage 97 in the exhaust path can be reliably stored.

As the suction port 40*a* of the exhaust blower 40 is located at a position higher than the position of the mist storage 97 in the exhaust path, the liquefied ink mist stored in the mist storage 97 in the exhaust path cannot be sucked by the exhaust blower 40.

Figure 12:
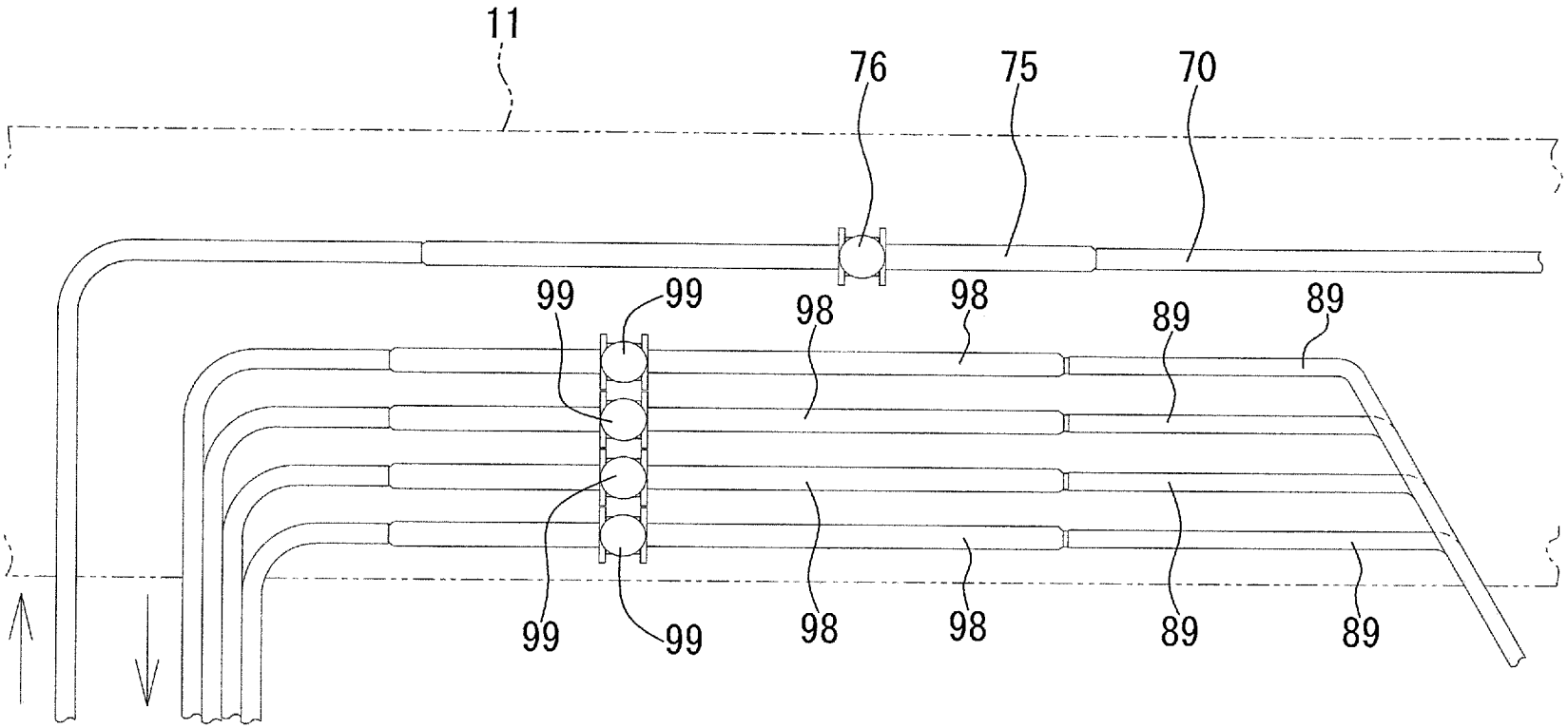
FIG. 12 is a partially enlarged plan view of an air blowing path and the exhaust path.

As shown in FIG. 12, the four main exhaust pipes 89 which are flexible pipes are each formed by a steel pipe 98 at a part in a length direction thereof, and an air flow meter 99 is provided on respective steel pipe 98. While the steel pipe 98 is located below the conveying belt 11, the position is not limited thereto.

A measured value of the air volume measured by the air flow meter 99 is transmitted to the control part 7. A monitor 6 is configured to set a reference value of the air volume.

The control part 7 compares the measured air volume with the reference value of air volume, and, when the measured value of air volume is lower than (falls below) the reference value of air volume, presents an abnormality such as alarm sound on the monitor 6. Such operation can be performed for each of the four air flow meters 99.

From the displayed abnormality on the monitor 6, an operator can recognize that the air volume exhausted from the exhaust blower 40 is small. The operator inspects the filters 84 of ink mist collecting part 43 and cleans or replaces the filters 84 when the filters 84 get clogged. The operator can repair the exhaust blower 40, when the exhaust blower 40 is found to be abnormal.

For facilitating the piping work and so on, a flexible pipe was used as the main exhaust pipe 89 on trial, but as the air flow meter was attached to the flexible pipe, disturbance of air flow occurred due to unevenness of the pipe, expansion of the pipe, or the like, which made impossible to accurately measure the air volume.

Therefore, a part of the main exhaust pipes 89 was made from steel pipes 98 and attached the air flow meters 99 to the steel pipes 98, as a result, air volume could be accurately measured without causing disturbance of air.

There may be provided a plurality of drains for discharging the liquefied ink mist adhered on the inner walls of the main exhaust pipes 89 on a position closer than the lowest position of the main exhaust pipes 89 to ink mist collecting part 43, separately from the mist storage 97 in the exhaust path described above.

For example, a drain (not shown) may be provided at the lowest position of the steel pipe 98 which is a part of the main exhaust pipe 89 shown in FIG. 12.

As the liquefied ink mist adhered on the inner wall of the steel pipe 98 can be discharged by operating the drain, the liquefied ink mist is thereby prevented from being stored on the inner wall of the steel pipe 98, and the air flow meter 99 provided on the steel pipe 98 is prevented from getting a failure.

As shown in FIG. 12, a part in a longitudinal direction of the main air blowing pipe 70 which is a flexible pipe is made of a steel pipe 75, and an air flow meter 76 is provided on the steel pipe 75.

It is possible to carry out various kinds of inspection, repairing and control works by using the measured value of the air volume measured by the air flow meter 76.

While, in this embodiment, four print heads are used, print heads are not limited thereto, five or more or three, or two print heads may be used.

While, in this embodiment, there are provided one air blower 30 and a plurality of air adjusting parts 33, so that the air volume of the vents 35 and 36 of the air blow nozzles 31 are respectively adjusted, there may also be provided the same number of the air blowers 30 as the air blow nozzles 31, so that the air volume of the respective air blowers 30 can be changed to adjust the air volume of the vents 35 and 36 of the air blow nozzles 31.

That is, it is enough to provide the air volume adjusting means which respectively adjusts the air volume of the vents 35 and 36 of the air blow nozzles 31*a*, 31*b*.

While, in this embodiment, there are provided a plurality of exhaust blowers 40, so that the suction air volume of the exhaust blowers 40 can be changed, and the suction air volume of the collection ports 45 and 46 of the collection nozzle 41 are adjusted, there may also be configured that one exhaust blower 40 is provided, the exhaust path is branched, the branched paths are connected to outlets of the respective collection nozzle 41, and air adjusting parts are provided on the respective branched exhaust paths, so that suction air volume of the collection ports 45 and 46 of the collection nozzle 41 may be adjusted.

That is, it is enough to provide suction air volume adjusting means which respectively adjusts suction air volume of the collection ports 45 and 46 of the collection nozzle 41.

What is claimed is:

1. An inkjet printer comprising:

a conveying part to convey a printing medium in a predetermined direction;

a printing part to print on a printing face of the printing medium conveyed by the conveying part;

an exhaust part to collect ink mist generated at the printing part; and a blowing part, wherein;

the printing part comprises a box, and a plurality of print heads spaced apart in a conveying direction of the printing medium inside the box, the blowing part comprises an air blower, a plurality of vents respectively provided at the respective print heads on an upstream side in the conveying direction of the printing medium, an air blowing path which connects an ejection port of the air blower and the respective vents respectively, and blowout air volume control means for respectively adjusting blowout air volume of the respective vents, the exhaust part comprises at least one exhaust blower, a plurality of collection ports respectively provided at the respective print heads on a downstream side in the conveying direction of the printing medium, at least one exhaust path which connects a suction port of the at least one exhaust blower and respective collection ports respectively, an ink mist collecting part provided in the exhaust path and configured to liquefy ink mist contained in the air sucked from respective collection ports, a mist storage tank in which liquefied ink mist is to be stored and a suction air volume control means for respectively adjusting suction air volume of the respective collection ports, the air blower, the exhaust blower, the blowout air volume control means, the ink mist collecting part and the suction air volume control means are provided outside the box, the ink mist collecting part comprises an inflow chamber which has an inflow hole at an upper part and which is opened at a lower part and an outflow chamber which has an outflow hole at an upper part and which is opened at a lower part, the inlet hole is connected to the collection ports, the outlet hole is connected to the suction port of the exhaust blower, so that air containing ink mist flows from the upper part to the lower part of the inflow chamber, flows in the lower part of the outflow chamber and flows from the lower part to the upper part of the outflow chamber, filters are provided in the inflow chamber and the outflow chamber respectively to liquefy ink mist while the air passes there-through, and the mist storage tank is provided below the inflow chamber and the outflow chamber, and a drain valve for discharging the liquefied ink mist within the mist storage tank is provided.

2. The inkjet printer according to claim 1, wherein:

the air blowing path is branched into as many air blowing paths as the vents, the branched air blowing paths are connected to the respective vents, there is provided an air volume adjusting part in each branched air blowing path as the blowout air volume control means, the air volume adjusting part is provided outside the box, there are as many exhaust blowers and exhaust paths as collection ports, the suction ports of the respective exhaust blowers are connected to the respective collection ports through the exhaust paths respectively, and the suction air volume control means is provided in order to make the suction air volume of each exhaust blower changeable.

3. The inkjet printer according to claim 1, wherein:

the vents are the vents of air blow nozzles, and the collection ports are the collection ports of collection nozzles, one air blow nozzle of a plurality of air blow nozzles is provided outside the box on an upstream side in the conveying direction of the printing medium, the other air blow nozzles are provided inside the box, one collection nozzle of a plurality of collection nozzles is provided outside the box on a downstream side in the conveying direction of the printing medium, and the other collection nozzles are provided inside the box.

4. The inkjet printer according to claim 3, wherein:

the vent of each air blow nozzle has a length enough to open throughout a whole area in a width direction of the printing medium and a plurality of inlets spaced apart in a length direction of the vent, the blowout air volume control means can adjust the volume of blowing air to be sent to the respective inlets, the collection port of each collection nozzle has a length enough to open throughout a whole area in the width direction of the printing medium and a plurality of outlets spaced apart in a length direction of the collection port, and the exhaust blower sucks air from the outlets.

5. The inkjet printer according to claim 1, further comprising a monitor and a control part, wherein:

at least a part of the exhaust path that is outside the box is constituted by a steel pipe, an air flow meter is provided on the steel pipe, and the control part displays an abnormality on the monitor, when an actual measured air volume of the air flow meter falls below a preset reference value of air volume.

6. The inkjet printer according to claim 1, wherein:

the exhaust path connecting the suction port of the exhaust blower and the ink mist collecting part has an inclined shape so as to be higher on the suction port side and ink mist collecting part side and lower at an intermediate part, and a mist storage is provided in the exhaust path at the lowest portion of the exhaust path.

7. The inkjet printer according to claim 1, wherein:

the printing medium is a building material.

* * * * *